United States Patent [19]

Pelz

[11] Patent Number: 4,754,976

[45] Date of Patent: Jul. 5, 1988

[54] PUTTER

[76] Inventor: David T. Pelz, 37 Tamarisk Cir., Abilene, Tex. 79605

[21] Appl. No.: 787,108

[22] Filed: Oct. 15, 1985

[51] Int. Cl.[4] ..... A63B 53/04

[52] U.S. Cl. ..... 273/169; 273/164; 273/80 C

[58] Field of Search ..... 273/168, 169, 170, 171, 273/172, 164, 163 R, 163 A, 194 R, 194 A, 194 B, 167 A, 167 G, 173, 174, 164, 80 C

[56] References Cited

U.S. PATENT DOCUMENTS

| | | | |
|---|---|---|---|
| D. 209,294 | 11/1967 | Hitt | 273/164 |
| 1,096,359 | 5/1914 | Dwight | 273/169 |
| 1,537,320 | 5/1925 | Marsh | 273/167 G |
| 2,222,534 | 11/1940 | Harris | 273/168 X |
| 3,260,525 | 7/1966 | Ortel | 273/164 X |
| 3,399,898 | 9/1968 | Burkland | 273/167 F |
| 3,758,115 | 9/1973 | Hoglund | 273/167 A |
| 3,966,210 | 6/1976 | Rozmus | 273/169 |
| 4,010,958 | 3/1977 | Long | 273/167 G |
| 4,138,117 | 2/1979 | Dalton | 273/164 |
| 4,508,350 | 4/1985 | Duclos | 273/169 X |

*Primary Examiner*—George J. Marlo
*Attorney, Agent, or Firm*—N. J. Aquilino

[57] ABSTRACT

A putter type golf club including a head, shaft and ball striking face, having its center of mass disposed at least 10 cm. behind the striking face creating an improved effective polar moment of inertia and a "shaft-force axis" disposed at a position relative to the center of mass creating a "self-aligning-stability" force throughout the acceleration portion of the putting stroke, wherein most of the head is made of lightweight material and a heavy weight is disposed in the head at a rearward location, at a substantial distance behind both the club head percussion center and the polar shaft axis.

3 Claims, 2 Drawing Sheets

PUTTER

BACKGROUND OF THE INVENTION

The present invention relates to golf club putters and more particularly to golf club putters having an improved weight and "shaft-force-axis" distribution system.

The majority of golfers who play the game of golf produce erratic and inconsistent golf swings. The same is true for putting strokes which exhibit very little in the way of repeatable performance. This is caused by a variety of reasons, both physical and mental, resulting in a rather large percentage of putts which are not hit on the "sweet-spot" or percussion center of the putter head and thus travel off-line with respect to an intended path toward a target. Each time a ball is struck from a point other than the center of percussion, a turning moment or force is created which seeks to rotate or turn the putter head, thus influencing the ball to roll a direction other than the intended target direction, and with less energy or speed transferred to the ball than originally intended. Both of these results adversely effect the performance and scoreing potential of the golfer. The result effected by the turning force is a function of both the distance between the point of impact and the center of percussion, and the clubhead's effective polar moment of inertia. Thus, a golf club head with a larger effective polar moment of inertia will turn less for a given off-center hit of a given force than a golf club head with a small or effective polar moment of inertia for the same hit.

Many efforts have been made to improve the performance characteristics of golf clubs, particularly golf putters, by increasing the moment of inertia primarily by altering the weight distribution characteristics of the club head. The most wellknown of these type of putter club heads use heel-toe weighting which concentrates the weight of the club head near or at the heel and toe portions. This arrangement tends to provide offcenter hits of a golf ball which cause less turning of the club head than occurs from similar impacts with clubs which have essentially even mass distribution across the hitting face. There also have been efforts to provide weight distributions high and low relative to the striking face of the putter club head to impart various characteristics to the ball being struck on a putting surface. Various mallet type putters have been provided with hollow interiors including means for adding or removing weights to control weight distribution.

Related patent art includes U.S. Pat. No. 1,537,320 to Marsh which shows a golf club having a protuberance which is rearwardly projecting and substantially elongated and cylindrical which is formed integral with the club head. The protuberance facilitates aiming and tends to overcome faulty shots by locating some of the club head mass at a somewhat increased distance from the point on the face of the club head which should properly engage the ball and thus increasing the club head effective polar moment of inertia, and reducing its propensity to turn or rotate.

SUMMARY OF THE INVENTION

The golf club putter of the present invention represents a substantial improvement over prior art devices and provides a unique weight distribution system which both increases the effective polar moment of inertia of the club head, which, in turn, provides for more solid and accurate striking of a golf ball and which substantially reduces the tendency of the club head to turn when the ball is struck on a point other than the exact center of percussion. The putter also provides a club which positions the "shaft-force-axis" or suspension point in such a position as to provide a substantial putter head self-alignment stability force during the acceleration portion of the golfers putting stroke, which, in turn provides an improved directional control for the golfer by keeping the putter striking face squarely aligned to the intended target line as the putter comes into impact with the ball to be putter.

The putter includes a head, shaft and grip. The head includes a body, the majority of which is constructed of relatively lightweight material, a ball striking face extending in a direction transverse to the longitudinal axis of the body and a weighting means located toward the rear portion of said body and behind the ball striking face, the center of percussion on the ball striking face, and the suspension point or location of the shaft-force-axis when extended to the longitudinal axis of the putter body.

Among the objects of the present invention is the provision of a golf club putter having a unique weight distribution system which increases the effective polar moment of inertia of the club head which, in turn, reduces or eliminates the turning of the putter head when a ball is struck on a point other than the center of percussion and the provision of a putter having a unique "shaft-force-axis" position relative to its weight distribution system which establishes a putter head self-alignment stability force during the actual use of said putter during the normal golf putting stroke.

The invention and its objects will be more readily understood from the following specification and accompanying drawings.

DESCRIPTION OF THE PREFERRED EMBODIMENTS

Figure 1:
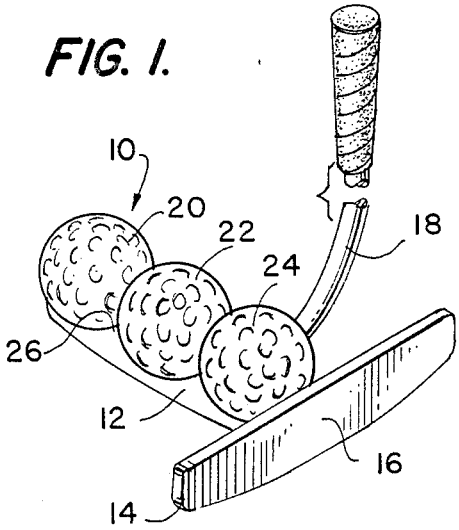
FIG. 1 is a perspective view of the putter head of the present invention.
Figure 2:
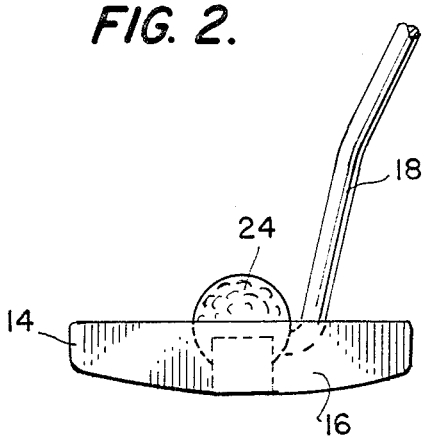
FIG. 2 is a front elevational view of the putter head of FIG. 1.
Figure 3:
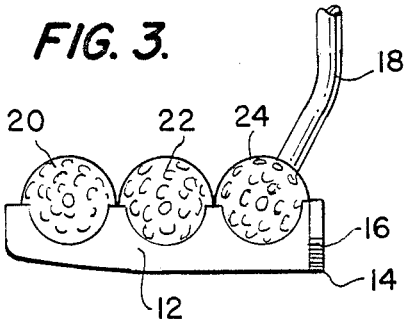
FIG. 3 is a side elevational view of the putter head of FIG. 1.
Figure 4:
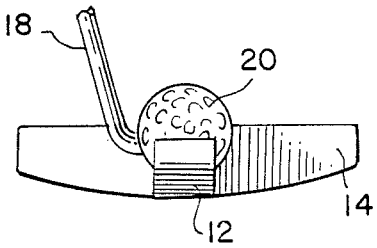
FIG. 4 is a rear elevational view of the putter head of FIG. 1.
Figure 5:
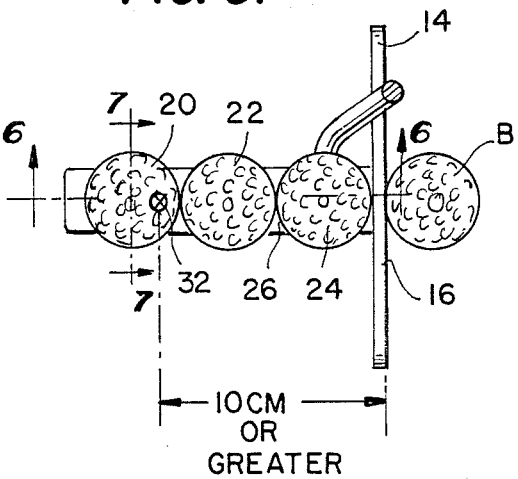
FIG. 5 is a top plan view of the putter head of FIG. 1.

The golf club of the present invention provides a unique weight distribution arrangement which greatly increases the effective polar moment of inertia of the golf club head which, in turn resists the turning of the club head when a ball is struck on a point other than the exact center of percussion, and a unique shaft-force-axis position relative to the mass distribution arrangement which creates a putter head selfalignment stability force as the golf club is used during an actual putting stroke.

When a ball is struck squarely on the center of percussion of any putter, there is no turning force or moment acting on the golf club head, and therefore, no energy absorbed by club head rotation. The ball receives the maximum amount of energy available from the club to propel it toward its intended target. However, when a ball is not hit on the exact center of percussion, a turning force or a moment is applied to the club head, the effectiveness of which is a function of the distance between the point of impact and the center of percussion. This turning force is resisted by the club head's effective polar moment of inertia in this plane of motion, as measured about the point of forced rotation, in this case the percussion center on the club face. The effective polar moment of inertia in such cases is determined to be;

$$I = \sum_{N=1}^{\infty} M_n R_n^2$$

where $M_n$ is each mass element of the club head and $R_n$ is the distance between each mass element and the forced point of rotation or percussion center.

With the present invention, the effective polar moment of inertia is greatly increased over conventional golf clubs, even those with peripheral weighting because the club head mass is located at a substantially greater distance from the ball striking face and percussion center than any of of the previously known prior art golf clubs which are currently used in the game of golf.

Conventional golf putters include center shafted blade types where the mass is distributed essentially evenly approximately 0.8 cm. behind the striking face. This produces a polar moment of inertia about the percussion center of approximately 2370 grams centimeter squared. A typical heel-toe weighted type of golf club having two major mass elements at the heel and toe of the golf club approximately 3.2 cm. from the percussion center and 1.2 cm. behind the ball striking face, produces a polar moment of inertia of approximately 3350 grams centimeter squared. The putter shown in U.S. Pat. No. 1,537,320 to Marsh shows a club head which can be equated to three essential mass elements located 2.9 cm., 2.9 cm., and 3.5 cm. from the percussion center, and about 0.7 cm., 0.7 cm. and 3.5 cm. behind the ball striking face. This produces an approximate polar moment of inertia of 2990 grams centimeter squared. Although this patent recognizes that by placing the center of the club head mass behind the impact point, the tendency for the club to turn is reduced, as a practical matter the effective polar moment of inertia created does not accomplish any resistance to the turning which is greater than the conventional putter structures. Another commercially available putter shown in U.S. Pat. No. 4,508,350 to Duclos is directed to a putter having two heavy mass elements at approximately 4.0 cm. from the percussion center and 1.2 cm. behind the ball striking face which produces a polar moment of inertia of approximately 4820 grams centimeter squared.

Because the resistance to turning or rotating of a club head on off-center of percussion hits is a function of the magnitude of the club heads's effective polar moment of inertia about its percussion center, it is clear that the unique mass distribution system of the present invention, with its main mass element positioned 10.5 cm. from the percussion center and 10.5 cm. behind the striking face, creates an effective polar moment of inertia of approximately 20,200 grams per centimeter squared. It is clear from a comparison with the examples cited above that the present golf club is superior in design and rotates less when a golf ball is hit off of the center of percussion and thereby better golf shots are produced.

A second feature of the golf club of the present invention is the provision of a unique shaft-force-axis position, relative to the polar center of mass of the club head, which provides an alignment stability heretofore unachievable with conventional putter structures. In any rigid physical system, if a heavy mass M is suspended in a plane by a weightless arm from a fixed suspension point P, and a vector force is applied in the specific direction within that plane to a suspension point P and if the force is great enough to accelerate the point P along the vector direction V, then the center of mass M will also move precisely and exactly in the vector direction. Due to the law of physics, the center of gravity of an object always follows exactly in the path of the force which is accelerating or moving the object's suspension point, if the suspension point is ahead of the object's center of gravity and no other extraneous forces are acting upon it. This elemental law of physics is used with the golf club of the present invention.

In a preferred embodiment of the invention, the golf club head is weighted substantially to the rear behind the ball striking face and percussion center. This structure creates a large effective polar moment of inertia which resists turning or rotation of the club head on off-center of percussion hits. The shaft-force-axis is also positioned a distance greater than 4.27 cm., the diameter of a conventional golf ball, forward of the club head center of gravity and precisely on the intended target line, which structure creates a substantial club head self-alignment stability force.

FIGS. 1 through 7 illustrate a first embodiment of a golf club putter 10 of the present invention including a body 12 having a wing-like member 14 with a flat ball striking face 16 and a shaft 18 attached to the body 12. A series of three-dimensional, simulated golf balls 20, 22 and 24 are formed on and become an integral part of the upper surface 26 of the body 12. The balls 20, 22 and 24 are aligned in a row perpendicular to the ball striking face 16 as shown in the drawings.

Figure 6:
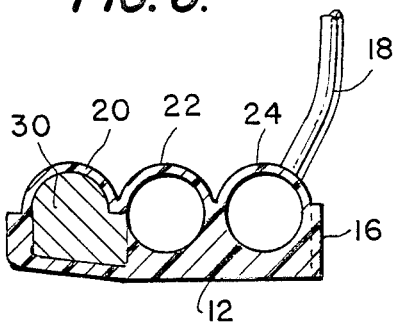
FIG. 6 is a sectional view taken along the lines 6—6 of FIG. 5.

The body 12 is formed of a lightweight material and includes a heavy weight 30, see FIG. 6, located at the extreme rear of the body on the longitudinal axis of the body 12 perpendicular to the ball striking face 16. The position of the weight 30 locates the center of mass c.g. of the putter 10 well behind the ball striking face and behind the force axis of the shaft 18 as described in detail hereinbelow.

Figure 7:
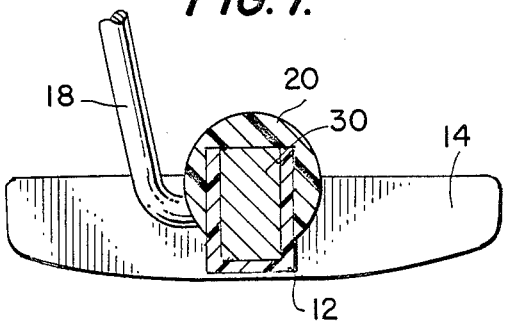
FIG. 7 is a sectional view taken along the lines 7—7 of FIG. 5.
Figure 8:
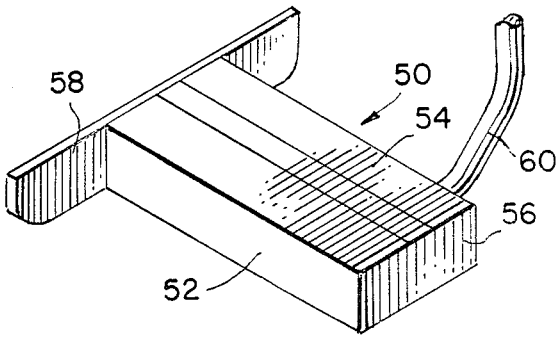
FIG. 8 is a perspective view of another embodiment of the putter head of the present invention.

In a preferred embodiment, the body 12 would be approximately 12 to 15 cm. long and the weight 30 would be positioned so as to locate the center of mass c.g. of the golf club head 10 approximately 10 to 12 centimeters behind the ball striking face and center of percussion. It has been found that the center of mass 32 may be located as little as approximately 4.27 cm., or the diameter of a golf ball, behind the face 16 and provide the increase in the effective polar moment of inertia as defined in the present invention. As shown in FIGS. 6 and 7, the weight 30 is preferably encapsulated within the lightweight body 12 during the molding process, although it may be inserted in any other conventional manner.

Figure 11:
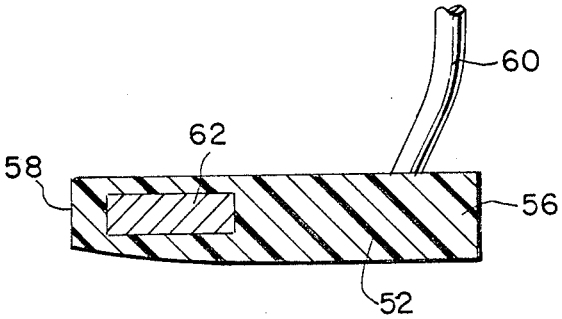
FIG. 11 is a sectional view taken along the lines 11—11 of FIG. 9.

FIGS. 8 through 11 illustrate another embodiment of a golf putter 50 of the present invention formed of a generally rectangular body 52 including a top surface 54 and ball striking face 56. The longitudinal axis of the body 52 is parallel to the direction along which a ball is to be struck 70 and perpendicular to the ball striking face 56. The bottom surface of the body 52 is swept upwardly toward the rear, as best seen in FIG. 11, to eliminate any tendency for the bottom of the putter 50 to scuff the putting surface as it is being swung. A wing-like member 58, which is slightly longer than the longitudinal dimension of the body 12, is attached at the rear surface of the body 12. It can be appreciated that many other shapes and dimensions of putter bodies wings and striking faces, can be substituted without effecting the mass distribution and shaft-force-axis described in this invention.

A shaft 60 is suitably attached to the body 52 and terminates in a conventional grip (not shown). The body 52 is made of a strong plastic such as Lexan TM or the like. A weight 62, in the form of a rectangular block is located within the body 52 adjacent to the rear of the longitudinal body away from the ball striking face 56, the percussion center 68, and the shaft-force-axis 64. As with the first embodiment, the weight distribution creates a center of mass which is toward the rear of the putter 50 well behind the striking face 56 and the force axis of the shaft 64. The top surface 54 of the body 52 is provided with a longitudinal stripe along its entire length to aid a player in the alignment of the putter 52.

Figure 9:
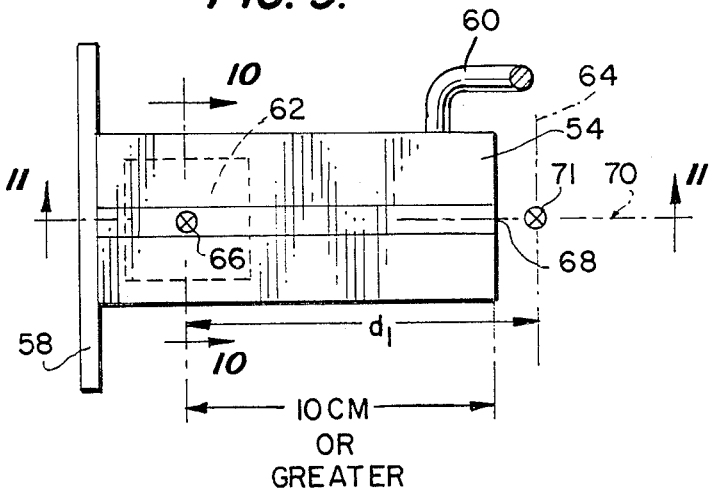
FIG. 9 is a top plan view of the putter head of FIG. 8.
Figure 10:
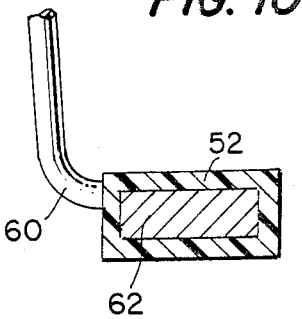
FIG. 10 is a sectional view taken along the lines 10—10 of FIG. 9.

With respect to the feature of alignment stability, the golf club of the present invention, as shown in FIG. 9, includes an extended axis 64 of the shaft 60 and its associated suspension point 71. The club head's center of mass 66 and the center of percussion 68 are all positioned precisely on the intended target line 70 along the longitudinal axis of the body 52. The shaft-force-axis suspension point 71 is positioned well forward of the club head center of mass by a distance D1 and the striking face 56 is exactly perpendicular to the intended target line 70. It can be seen from this example, which is equally applicable to the other embodiments, that if a force is applied to the golf shaft 60, and the extension of the shaft-force-axis 64 intersects the intended target line 70 at 71, the club head center of mass 66 will move in the same direction as the applied force. This will keep the ball striking face 56 perpendicular to the force as long as the force is accelerating the golf club head.

If the shaft-force-axis is not positioned exactly on the intended target line, then the club head mass will inherently misalign the putter face when an accelerating force is applied to the putter shaft 60 during a normal putting stroke. If the shaft-force-axis is positioned on the intended target line 70, then the magnitude of the self-aligning force is the function of the distance between the shaft axis suspension point and the club head center of mass 66 which is greater than 4.27 cm. as shown.

I claim:

1. A golf putter comprising a shaft and club head, said club head having a ball striking face and an elongated body perpendicular to said ball striking face and symmetrically shaped laterally along its longitudinal axis; said club head being further defined by having its center of mass located along the longitudinal axis of said body and in the rearward third of said elongated body at least 10 cm behind said ball striking face and rearward of the force axis of said shaft, which force axis intersects either a line coincident with the longitudinal axis of said elongated body or a line defining a forward extension of said longitudinal axis, said golf club head being further characterized by having an effective polar moment of inertia in excess of 10.000 grams centimeter squared;

said effective polar moment of inertia being defined by the equation:

$$I = \sum_{N=1}^{\infty} M_n R_n^2$$

where $M_n$ is the mass element of the club head and $R_n$ is the distance between the center of mass and said ball striking face.

2. The golf putter of claim 1 further characterized by a weight located in said rearward third of said elongated body.

3. The golf putter of claim 1 wherein said elongated body is further characterized by having a rectangular shape.

* * * * *